United States Patent [19]

Laplanche

[11] 4,384,708

[45] May 24, 1983

[54] FEEDING PROCESS FOR A DEFIBRATOR

[75] Inventor: Pierre Laplanche, Turckheim, France

[73] Assignee: S. A. Beghin-Say, Thumeries, France

[21] Appl. No.: 224,288

[22] PCT Filed: Nov. 30, 1979

[86] PCT No.: PCT/FR79/00116

§ 371 Date: Aug. 22, 1980

§ 102(e) Date: Aug. 21, 1980

[87] PCT Pub. No.: WO80/01290

PCT Pub. Date: Jun. 26, 1980

[30] Foreign Application Priority Data

Dec. 22, 1978 [FR] France ..... 78 36080

[51] Int. Cl.[3] ..... B41L 1/30

[52] U.S. Cl. ..... 270/40; 19/82; 19/163; 156/227; 493/390

[58] Field of Search ..... 270/39, 40, 45, 46, 270/51, 32; 19/160, 161.1, 163, 82; 156/202, 204, 227; 493/350, 390, 356–360, 436; 131/369, 370, 357, 358, 327

[56] References Cited

U.S. PATENT DOCUMENTS

| | | | |
|---|---|---|---|
| 1,767,860 | 6/1930 | Shaffer | 270/45 X |
| 3,382,778 | 5/1968 | Berkowitz | 270/45 X |
| 3,701,522 | 10/1972 | Chi | 270/39 |
| 4,081,305 | 3/1978 | Patin | 19/163 X |

*Primary Examiner*—A. J. Heinz
*Attorney, Agent, or Firm*—A. W. Breiner

[57] ABSTRACT

A process for feeding defibrators with sheet pulp delivered in batches. Rectangular sheets are deposited one behind another on a feed belt with their longitudinal axis offset by 45° with respect to the direction of advance of the belt, whereupon two equal lateral parts from each sheet are folded back along two folding lines parallel to the direction of advance of the belt, the distance e between said lines being equal to $l/\sqrt{2}$ and two consecutive sheets being mutually apart by $x=L/\sqrt{2}$, L and l, respectively, being the length and the width of the pulp sheet. Feeding a machine for diapers.

8 Claims, 7 Drawing Figures

FEEDING PROCESS FOR A DEFIBRATOR

TECHNICAL FIELD

The present invention concerns a process for feeding defibrators with sheet pulp delivered in batches.

STATE OF THE PRIOR ART

In plants which are insufficiently integrated or not integrated at all and the so-called "fluff" absorbing cellulose based articles, the pulp as a rule is fed in the form of rolls because this allows a uniform and constant feed of the(se) machine(s).

The use of rolls suffers, however, from the drawback of being approximately 40% more costly than batch pulp. Batch pulp would be very economical. To that end, one may imagine sheets of pulp one behind the other, on the feed belt of a defibrator, or else meshing like roof-tiles.

Such arrangements suffer from the main drawback that they entail an uneven feed to the paper machine because the sheets' "tails," in full width, are instantly "swallowed" by the defibrator the moment they no longer are pinched by the drive rollers of this machine. This would result at the output end of these machines in a sudden product weight surplus followed by a weight shortage. This periodic variation might affect approximately 30% of the production.

On the other hand, the industrial formats of rectangular sheets as a rule are very large, considering the dimensions of the openings of the defibrators or grinders.

Other processes have been implemented (for instance the "MODO" system), which consist in achieving prechipping of the pulp which is temporarily stored in this form and subsequently treated again by beaters which generally are of the disk type. These plants again fail to provide a uniform flow of defibrated pulp, so that a high cost of production results, on one hand due to the power involved and on the other because it is necessary to run at a higher average weight in order not to fall below the minimum values which determine the quality and hence the value of the product.

DISCUSSION OF THE INVENTION

The object of the present invention is to conceive a novel feed process for a defibrator by sheet pulp delivered in batches. Uniform feed is achieved by relatively simple means.

To that end rectangular sheets are deposited one behind the other on a feed belt with their longitudinal axis shifted by 45% with respect to the direction of advance of the belt, then at least one lateral part of each sheet is folded back along a folding line parallel to the belt's direction of advance, the accurate superposition of the parts of single thickness with the folded sheets allowing the achievement of a constant cross-section.

The term "rectangular sheet" denotes also the square sheets to which the present invention remains applicable mutatis mutandis.

In a preferred mode of implementation of the invention, two lateral identical parts of each sheet are folded back along said folding lines which are parallel to the belt's direction of advance.

In this case the distance between said lines is equal to $l/\sqrt{2}$ and two consecutive sheets are apart by $x=L/\sqrt{2}$, where L and l, respectively, are the length and width of the pulp sheet.

In this case the sheets mesh on the feed belt, that is, two consecutive sheets partly straddle each other.

By adjusting in this manner the distance between two consecutively advancing sheets, a precise superposition of the single-thickness parts with the folded sheets is obtained. It is possible thereby to obtain a constant material thickness along the length of the tissue formed by the overlap corresponding to twice the thickness of the single sheet, and therefore a uniform feed.

In a variation of the implementing mode of the invention above, the lateral folded back parts may be other than identical. In this case the distance e between said folding lines always is equal to $l/\sqrt{2}$, and in the same manner, two consecutive sheets are mutually apart by the same distance $x=L/\sqrt{2}$, but, and this is very important, this variation implies an additional process stage consisting in making one rectangular sheet out of two pivot by 180° in its plane.

In this case the sheets are overlapping only after the lateral parts of the sheets have been folded and after one sheet out of two has been rotated.

It was found that the tail of the width is suddenly driven when in the "downstream" position of the other sheets in the course of the working of the defibrating tool (bottom sheet for a defibrator operating by downward displacement).

For that reason, the sheets preferably will be overlapping one underneath the other on the feed belt, and the lateral parts will be folded back by pivoting upward. In this manner the "tails" will be in the upper part.

Obviously the overlap can also be implemented by successively placing the sheets one on top of the other, which would slightly simplify the overlap proper, but would require the lateral parts to be folded back downward, which industrially would be more complex both as regards the equipment and operational control.

It is also possible to fold back only one lateral part. In this case the folding line is the bisector of the most forward angle of the rectangular sheet and it is also necessary in this case that one sheet out of two be pivoted by 180° prior to forming the constant cross-section tissue.

In another variation of the process of the invention, for certain geometric conditions, it is possible to superpose the single-thickness surfaces of sheets folded along a direction other than that which makes an angle of 45° with the longitudinal direction of the sheet.

It has been shown that for each type of rectangle defined by the ratio of its dimensions, only one angle $\alpha$ of the slope of the folding lines with respect to the longitudinal dimension of the rectangle is possible.

In this variation, the process in addition to the deposition of the sheets on a belt also comprises forming the folds and the folding proper, a turning-over of one sheet out of two to superpose the single-thickness parts. In the present variation, an actual turning over, and not a mere rotation of 180° of the sheet in its plane is involved.

It is also possible to obtain a tissue of constant thickness which is equal to four times the thickness of the single sheet by superposing two tissues of two thicknesses obtained by any one of the above-cited modes of implementation of the invention.

Preferably, however, the two tissues will not be superposed, rather a single layer of four sheets will be formed, the distance x defined above separating the "even order" consecutive sheets and shall be equal to the distance between the consecutive "odd order" sheets.

In particular and for practical reasons, an offset equal to x/2 will be selected between the two sheet series, whereby it will be possible to deposit the sheets at a constant offset on the feed belt.

PREFERRED IMPLEMENTATION OF THE INVENTION

Figure 3:
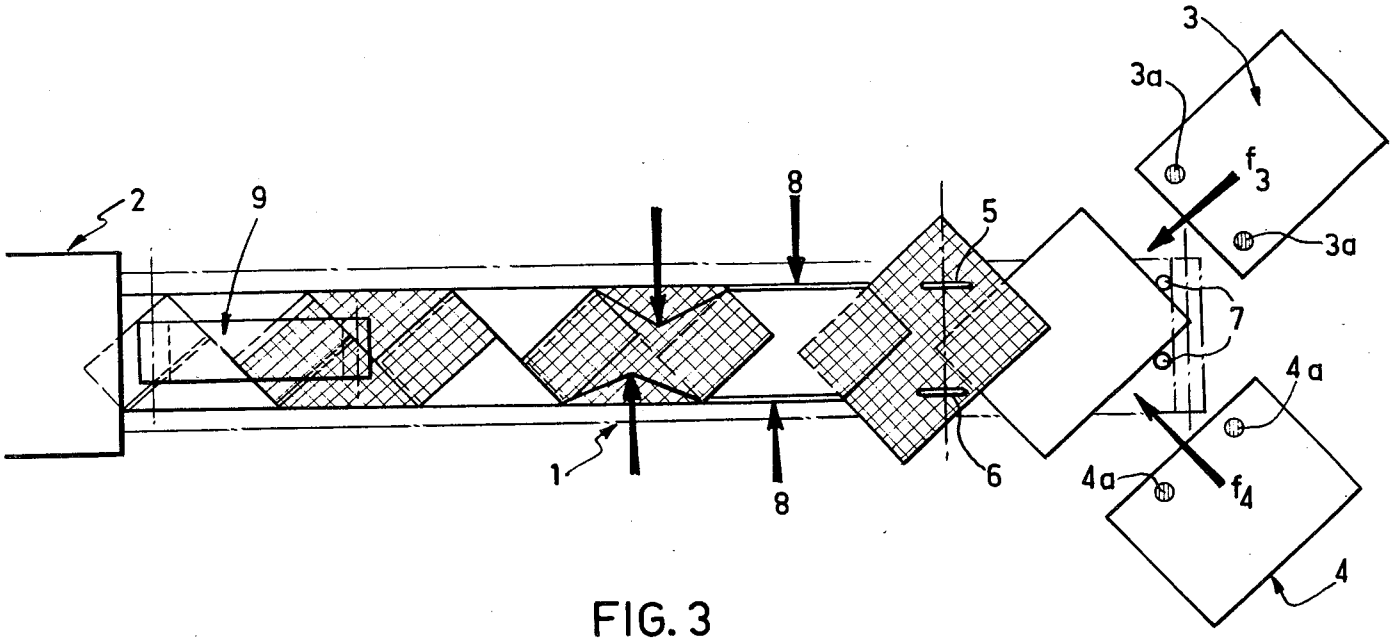
FIG. 3 is a sketch showing the various stages of the feed process of the invention.

The process is mainly illustrated in the schematic drawing of FIG. 3. Reference 1 is the feed belt for a defibrator 2. Batch 3 of paper pulp in the form of rectangular sheets is arranged so its longitudinal axis corresponds to the length of the sheets and directed toward the feed belt and subtending an angle of 45° with the latter's direction of advance.

A second pulp batch 4 is shown in the sketch of FIG. 3 with its transverse axis corresponding to the width of the sheets and directed toward the feed belt and shifted by 45° with respect to the latter's direction of advance. The arrangement of the second pulp batch allows feeding the defibrator without any interruption, the sheets of batch 4 being automatically gripped after the batch 3 is exhausted, and vice-versa.

The sheets are individually distributed by a vacuum gripping system. Preferably two vacuum holes 3*a* and 4*a*, respectively, grip the upper sheet of the batch toward the "forward" angles in the sense of the distribution of arrow $f_3$ and $f_4$ in order to deposit them in the "overlap" position on the feed belt.

The overlap may be accomplished in two ways, either consecutively the one on the other, or consecutively the one underneath the other. For the reasons already cited, the overlap preferably is carried out in the second manner.

The pulp sheets are overlapping in the diagonal position with an offset controlled by the feed rate which may be controlled for instance by photo-electric detection and pass next into a marking station provided with two sets of rotating tools 5, 6 for marking the folds which will allow folding back the lateral parts of the continuous band so made with greater facility and with more geometric precision.

The spacing of the marking tools is $e=l/\sqrt{2}$, where l is the width of the rectangular sheet.

To accurately position the rectangular sheet on the feed belt, in particular to achieve the transverse position on the belt, and to adjust the offset value, the sheet is butted by centering and thrust stops denoted by 7.

Figure 1:
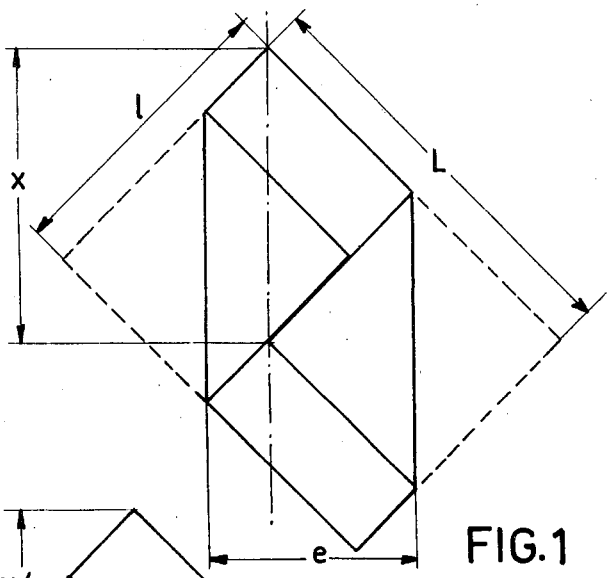
FIG. 1 is a sketch showing one sheet folded in conformity with the invention.

The position of the centering stops is such that the two folded-back lateral parts of the sheet are of equal dimensions, as indicated in the sketch of FIG. 1 which shows a rectangular sheet folded back by the process of the invention.

Figure 2:
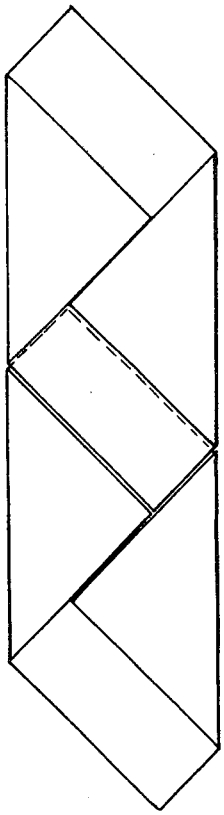
FIG. 2 is a sketch showing two consecutive sheets folded in conformity with the invention and overlapping with an offset "x".

Reference 8 of FIG. 3 schematically shows the station where folding takes place. By adjusting the overlap distribution with an offset equal to "x" (FIG. 1), a precise superposition of the single ply parts is obtained with the folded sheets, to obtain a material of constant thickness corresponding to twice the thickness of the single ply sheet over the entire length of the tissue consisting of the overlap, as shown in the drawing of FIG. 2.

As indicated above, the precision of the feed rate may be obtained by any adequate known means such as photo-electric detection for instance.

The value x of the offset corresponds to the following definition: $x=L/\sqrt{2}$, where L is the length of the rectangular sheet.

By feeding the defibrator in this manner, the amount of treated pulp is very uniform and equal to the constant weight of the sheets at the input, inside and at the output of the defibrator, which simplifies the uniform formation of the fiber component.

Reference 9 (FIG. 3) schematically represents a compression-roller path.

Figure 4:
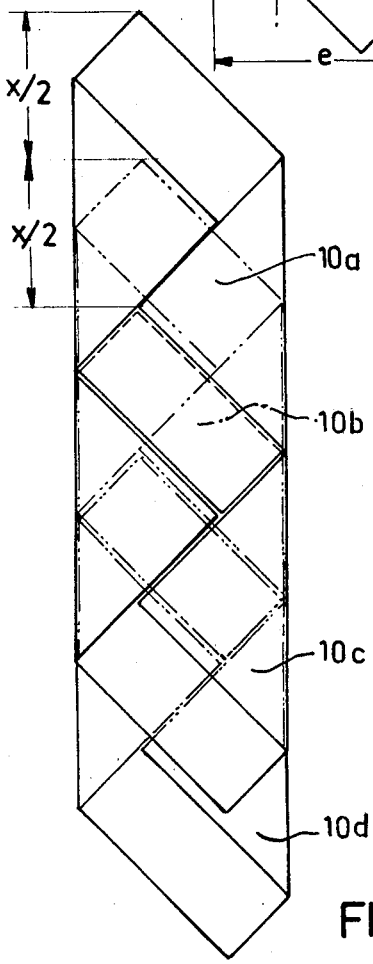
FIG. 4 is a sketch showing a four-ply pulp layer made in conformity with the invention.

As regards the mode of implementation shown in FIG. 4, the sheets are mutually apart by a distance of x/2. The "even order" consecutive sheets 10*a*, 10*c* form a double-ply tissue similar to that shown in the drawing of FIG. 2. The "odd order" consecutive sheets 10*b*, 10*d* form a second tissue identical with the first one.

The whole constitutes a four-ply tissue. The two tissues in the drawing of FIG. 4 are advantageously formed using a uniform offset equal to half the distance x.

Figure 5:
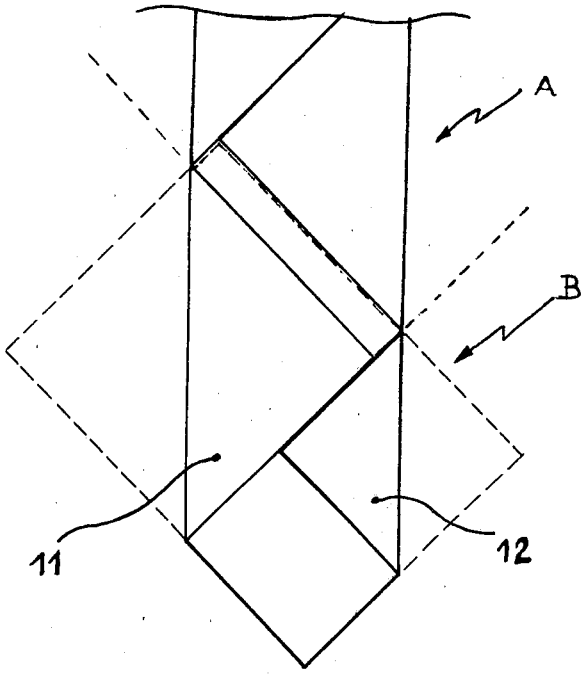
FIG. 5 is a sketch illustrating another mode of implementation of the invention (folding back two non-identical lateral parts).

In a second example illustrated by the sketch of FIG. 5, the folded-back lateral parts (11,12) of each sheet no longer are identical. It suffices then to pivot by 180° in its plane one sheet out of two in order to produce a constant cross-section tissue (sheet B in the sketch of FIG. 5). Then the single-ply parts become complementary.

Figure 6:
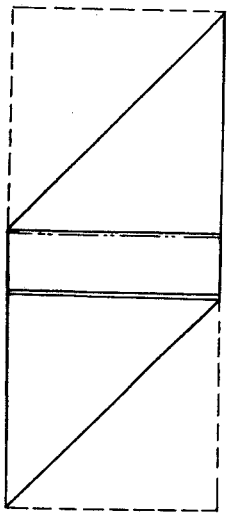
FIG. 6 is a sketch illustrating another mode of implementation of the invention (folding back a single lateral part).

In a third example illustrated by the sketch of FIG. 6, a single lateral part is folded back along the bisector of the most forward angle. As in the previous example, one sheet out of two must be pivoted in its plane by 180°. Then the overlap takes place only after the folding operation.

Figure 7:
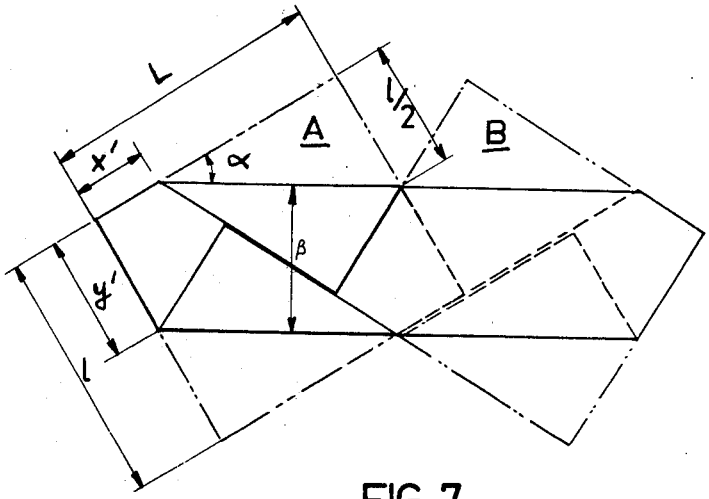
FIG. 7 is a sketch illustrating another mode of implementation of the invention (folding back two parts along a direction less than 45°).

In a fourth example illustrated by the sketch of FIG. 7, the direction of the folding lines is not 45° with respect to the longitudinal direction of the sheet. In this case, there is only a single value of the angle $\alpha$ allowing folding as defined by the invention for a given rectangle.

Computation shows that the angle $\alpha$ is given by the formula below:

$$\alpha = \arctan\left(a - \sqrt{a^2 - 1}\right)$$

where a is the ratio L/l of the dimensions of the rectangle. By definition, the ratio exceeds unity. In such a case, as shown in FIG. 7, if x' and y' are the respective distances from the engaged edge of the rectangular sheet to the beginning of the folding lines, there follows:

$$x' = \frac{l}{2} \tan \alpha \text{ and } y' = \frac{l}{2}$$

The width $\beta$ of the folded rectangular sheet under these conditions is equal to:

$$\beta = \frac{l}{2 \sin \alpha}$$

Once the sheets A and B are folded, it suffices to turn over one sheet out of two. Thereupon the second sheet referenced by B may be overlapped with the first one so that the single ply parts are superposed (see the accomplished overlap in FIG. 7).

I claim:

1. Process for feeding defibrators with pulp in rectangular single-ply sheets delivered in batches, each sheet being defined by its length L, its width l and its longitudinal axis, including the steps of depositing a plurality of rectangular sheets one after another on a feed conveyor belt moving in the direction of the defibrator, the longitudinal axis of the deposited rectangular sheets forming an angle $\alpha$ with the moving direction of the feed conveyor belt, $\alpha$ being greater than zero and less than 90°, each sheet partially overlaping the preceding sheet, folding back at least one lateral part of each sheet along a folding line parallel to the moving direction of and while on the feed conveyor belt so as to form at least one two-ply part, and accurately superposing the single-ply parts of consecutive sheets in order to obtain a pulp mat of constant thickness.

2. Process according to claim 1 wherein the angle $\alpha$ is 45 degrees and two identical lateral parts of each sheet are folded back along two folding lines parallel to the direction of advance of the feed conveyor belt, a distance e between said folding lines being equal to $l/\sqrt{2}$, and two consecutive sheets being apart from each other by $x=L/\sqrt{2}$, L and l, respectively, being the length and the width of the pulp sheet.

3. Process according to claim 1 wherein the angle $\alpha$ is 45 degrees and two identical lateral parts are folded back along two folding lines parallel to the direction of advance of the belt, and wherein one rectangular sheet out of two is made to pivot in its plane by 180 degrees, a distance e between said lines being equal to $l/\sqrt{2}$ and two consecutive sheets being mutually spaced apart by $x=L/\sqrt{2}$, L and l being, respectively, the length and the width of pulp sheet.

4. Process according to claims 2 or 3 wherein the sheets are deposited consecutively one underneath the other on the feed belt and the lateral parts are folded back by pivoting upwards.

5. Process according to claim 1 wherein "even-order" sheets are deposited so that consecutive "even-order" sheets are spaced apart by said distance x and wherein "odd order" sheets are deposited so that consecutive "odd order" sheets are spaced apart by said distance x, in order to obtain a thickness four times that of a single pulp sheet.

6. Process according to claim 5 wherein said sheets are deposited one after another with a uniform offset equal to half said distance x.

7. Process according to claim 1 wherein the angle $\alpha$ is 45 degrees and said rectangular sheets are folded along the bisector of said $\alpha$ angle and one sheet out of two is made to pivot in its plane by 180 degrees, a distance between two consecutive sheets being equal to the width of the rectangular sheets along the direction of the length of said sheets.

8. Process according to claim 1 wherein the angle $\alpha$ is less than 45 degrees and is a function of the ratio of the length to the width of the rectangular sheet given by the formula:

$$\tan \alpha = \left[ \frac{L}{l} - \sqrt{\left(\frac{L}{l}\right)^2 - 1} \right]$$

whereupon one sheet out of two is turned back in order to superpose the single-ply parts.

* * * * *

UNITED STATES PATENT AND TRADEMARK OFFICE

CERTIFICATE OF CORRECTION

PATENT NO. : 4,384,708

DATED : May 24, 1983

INVENTOR(S) : Pierre Laplanche

It is certified that error appears in the above-identified patent and that said Letters Patent is hereby corrected as shown below:

Column 1, line 52, "45%" should read -- 45° --.

Column 6, line 12, "claim 1" should read -- claim 4 --.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*